US012305394B2

(12) United States Patent
Kuse

(10) Patent No.: US 12,305,394 B2
(45) Date of Patent: May 20, 2025

(54) SUPPORT MADE FROM STONE AND TENSION-RESISTANT MATERIAL

(71) Applicant: Kolja Kuse, Munich (DE)

(72) Inventor: Kolja Kuse, Munich (DE)

(73) Assignee: Kolja Kuse, Munich (DE)

( * ) Notice: Subject to any disclaimer, the term of this patent is extended or adjusted under 35 U.S.C. 154(b) by 220 days.

(21) Appl. No.: 17/766,100

(22) PCT Filed: Oct. 3, 2020

(86) PCT No.: PCT/EP2020/000171
§ 371 (c)(1),
(2) Date: Apr. 1, 2022

(87) PCT Pub. No.: WO2021/063536
PCT Pub. Date: Apr. 8, 2021

(65) Prior Publication Data

US 2022/0372759 A1 Nov. 24, 2022

(30) Foreign Application Priority Data

Oct. 3, 2019 (DE) ..... 20 2019 004 090.0
Feb. 22, 2020 (DE) ..... 20 2020 000 730.7

(51) Int. Cl.

| | |
|---|---|
| ***E04C 3/29*** | (2006.01) |
| ***E04C 2/26*** | (2006.01) |
| ***E04C 3/06*** | (2006.01) |
| *E04C 2/00* | (2006.01) |
| *E04C 3/04* | (2006.01) |

(52) U.S. Cl.
CPC ..... *E04C 3/29* (2013.01); *E04C 2/26* (2013.01); *E04C 3/06* (2013.01); *E04C 2002/004* (2013.01); *E04C 2003/0452* (2013.01); *E04C 2003/046* (2013.01)

(58) Field of Classification Search
CPC ..... E04C 3/29; E04C 3/06; E04C 2/26; E04C 2002/004; E04C 2003/0452; E04C 2003/046
USPC ..... 52/836
See application file for complete search history.

(56) References Cited

U.S. PATENT DOCUMENTS 3,271,917 A * 9/1966 Rubenstein ..... B29C 70/12 52/309.17

FOREIGN PATENT DOCUMENTS

DE 202006009793 U1 12/2006
FR 2422001 A1 11/1979

* cited by examiner

*Primary Examiner* — Mark R Wendell
(74) *Attorney, Agent, or Firm* — Perry + Currier Inc.

(57) ABSTRACT

The invention describes a girder profile made of stone material and tensile-resistant material, which is preferably made of CO2 in order to fix greenhouse gases. This is intended to replace steel girders and aluminum girders with sustainable building materials.
The invention adopts the principle of dovetailing from timber construction and transfers this principle to the structure made of stone material and fiber material, in that the planes of the profile, which usually meet orthogonally, overlap geometrically with regard to the tension-stable material parts or at least meet in one cutting plane.
Such materials made of mineral substances and fibrous materials are significantly lighter, more durable and more ecological than such carriers made of metallic materials.

12 Claims, 8 Drawing Sheets

Cross section G - G

SUPPORT MADE FROM STONE AND TENSION-RESISTANT MATERIAL

FIELD

The present invention relates to the development of a standard profile commonly used in the construction sector, which today is usually made of steel material, known as a T-beam or double T-beam.

BACKGROUND

Such a girder consists of three elongated plates, which are connected to each other in the longitudinal direction and arranged at right angles to one another, has a pressure-stable upper chord and a tension-stable lower chord, also called a flange, and a web connecting the lower chord and upper chord, which is typically arranged symmetrical in the middle of the flanges. There are also U-profiles with a ridge on one of the two sides, or box profiles with 2 ridges on the sides.

The invention also relates to such or similar and other profiles such as:

P-profile with parallel inner surfaces of the flanges, also known as "Peiner" or Peiner carrier;

U-profile with inclined inner surfaces of the flanges;

U-profile with parallel inner surfaces of the flanges;

T-profile isosceles;

L-profile (also angle iron, angle profile or angle bracket);

as well as all possible variations of box sections and V-profiles and combinations of these profiles.

With such profiles, an optimal load-bearing capacity for the respective application is achieved in relation to the mass of the material used and thus its weight.

In the case of I-beams, the height of the central bar or web essentially determines the rigidity of the beam. Secondary measures for increasing the rigidity are the targeted increase in the tensile stability of the lower flange and the targeted increase in the compressive rigidity of the upper flange, Since such girders are hot-rolled from steel, the upper and lower chords are identical for the sake of simplicity.

The advantage of steel beams of this type is cheap manufacturability in large quantities and reliable load-bearing capacity. Defects are rare in such profiles and can be neglected in practical use. In addition, additional steel parts for connecting beams to other load-bearing parts can be easily welded at the construction site at any time and place as required.

The disadvantage is the extremely high density of steel at 7.8 g/cm3 and the fact that steel production involves large amounts of energy and high $CO_2$ emissions. So far, the only replacement for steel has been aluminum, which is lighter but has an even higher ecological footprint than steel. For this reason, the quantities of mass steel required cannot be produced with aluminum.

For this reason, steel is generally regarded as an indispensable building material, which apparently cannot be replaced even from a climate protection point of view, which is why work is being done on reducing steel with hydrogen, which makes steel even more energy-intensive to produce.

However, in recent reports by SITRA, commissioned by the Finnish government, it is clear that today's levels of steel, aluminum and cement alone account for the remaining amounts of $CO_2$ to be emitted by 2100, if that 2° C. target according to the Paris climate Agreement is to be met. This fact makes it compelling to first reconsider the indispensability paradigm of steel or metal.

EP 106 20 92 and EP 273 94 71 describe how steel and aluminum can be replaced by a combination of stone and carbon fiber laminate (CFRP—carbon fiber composite) if the stone is given the lack of tensile stability by the extremely stiff carbon fiber. The connection between stone and fiber is made with the help of resins, for example epoxy resins or high-temperature stable binders based on water glass and silicone, which are able to crosslink or bond with the carbon material. Under certain circumstances, these connections also produce a prestress which can be permanently built into or through the connection.

DETAILED DESCRIPTION

Figure 1:
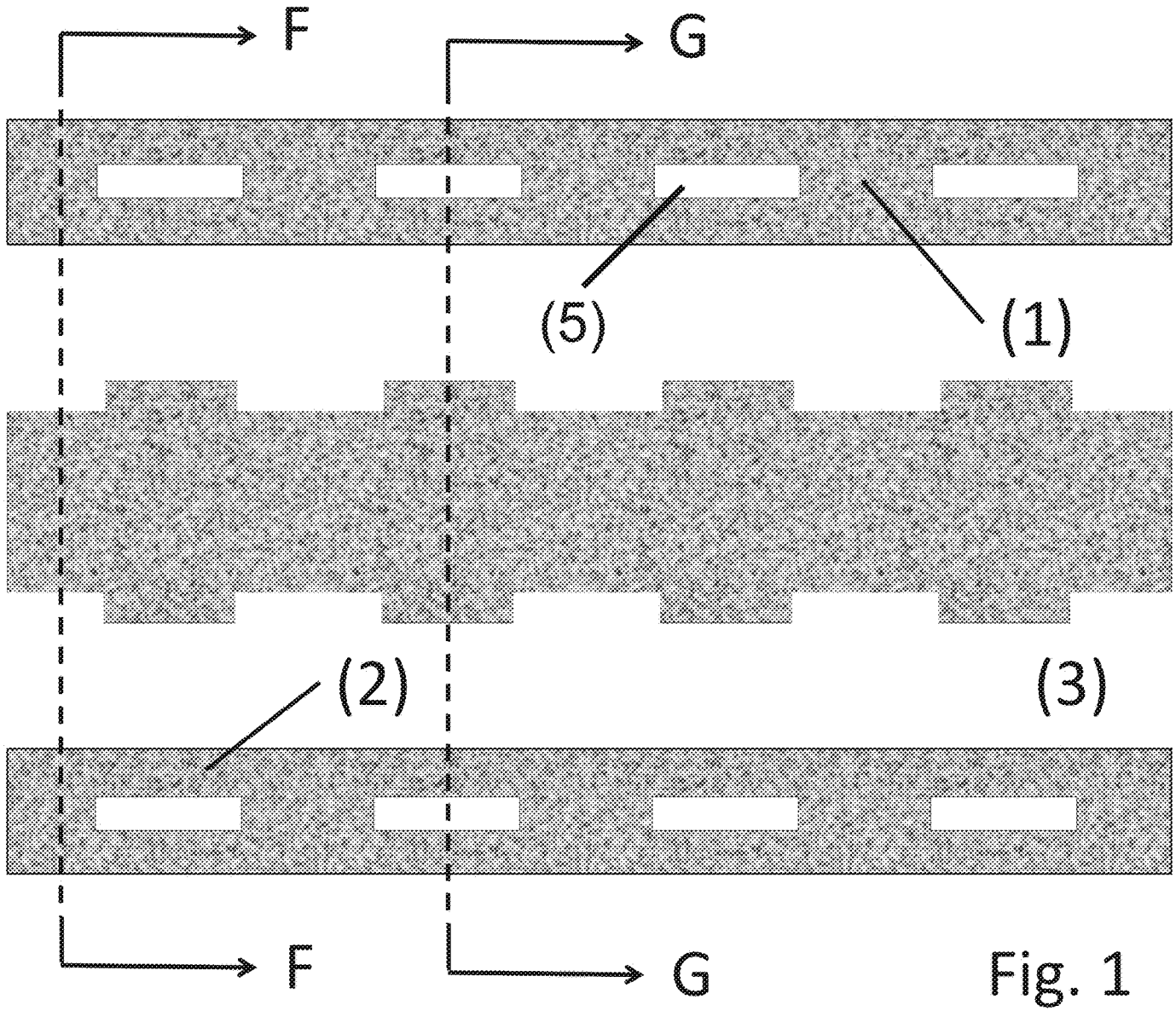
FIG. 1 is a diagram of components of a double T-beam.

The invention describes a technical way of how such a double T-beam can be exemplary designed to transfer the utilization of the CFRP stone composite (CFS—CarbonFaserStein or CarbonFiberStone) to practicable and optimized structures or geometries, as being known in the construction area already. The technical design is shown in FIGS. 1 to 8 as an example for a double T-beam and a single T-beam. The main challenge here is to connect the surfaces that are perpendicular to one another in a force-fitting manner without local stress peaks causing the geometry to fail completely at an early stage through local failure. The frictional connection of the surfaces is in principle established with the help of glues or adhesives. This applies to the production of the CFRP stone composite (CFS) and to the connection of the CFS parts themselves. For this purpose, the base plate material in FIG. 1 is first produced, which arranges the carbon layer (4) in the middle between two stone plates.

Then the parts to be connected are provided with dovetailing, just as in carpentry wooden panels are prepared with dovetails, which optimize the orthogonal connection of wooden panels. In the case of wood, too, the effect is ultimately used that orthogonally meeting fiber layers are connected to one another in a cross-over or overlapping manner, since butt bonding without geometric overlapping would only be limited to the adhesion of the adhesive, which would ultimately fail quickly due to its insufficient tensile stability. Due to the dovetailing of the transitions, the power transmission from one tension-stable plane to the other orthogonal tension-stable plane is almost completely achieved when the two tension-stable planes, in our exemplary case in FIGS. 1 to 8 the carbon layers—within the stone layer(s)—are spatially overlapping in view of the cross sections.

In fracture tests, it could be proven that a double T-beam made of CFS plates can carry similarly high loads as a comparable steel beam, whereby the CFS beam is significantly lighter, since stone with a specific weight of 2.8 g/cm3 is significantly lighter than steel, and stone and carbon cause significantly less $CO_2$ emissions during production than steel. Savings of 30-50% can be expected. The overall construction shows itself to be elastic in the fracture test, without the bonded dovetail breaking up when the beam bends.

In order to ensure sufficient tensile stability in the lower belt, only relatively thin and light layers of carbon are required, which also reduce the total weight in relation to the total volume. The compressive rigidity on the upper chord and in the web is achieved by the stone component. In addition to carbon, many other fiber materials can also be used that have a significantly smaller ecological footprint than carbon fibers. Glass fibres, basalt fibres, stone fibres, steel fibers and flax fibers are also suitable as examples depending on the application. From a technical point of view, however, the carbon fiber is of particular importance because, in contrast to most other fibers, it has a significantly higher tensile stiffness. This applies in particular to graphene-based structures, which are not fibers in the strict sense, but can also be used as reinforcement in the future. Another effective measure to further reduce the carbon footprint is the production of carbon and graphene from sustainable resources, for example from algae oil or other vegetable-based oils from algae or yeasts, carbon fibers from lignin, i.e. from wood waste from paper production, or carbon fibers from synthetically produced methanol using the extended Fischer-Tropsch synthesis and water-gas shift reaction. Graphene can also be obtained directly from $CO_2$ using electrical energy. In these cases, a part of the building material—in the case that the tension-resistant layer consists of carbon fibers or graphene—essentially comes from $CO_2$ sources, whereby the carbon, which previously had a climate-damaging effect in the form of $CO_2$, is now bound permanently within the fiber and thus also in the Building material in solid form. This is one of the reasons why carbon fiber is particularly important as a material with high tensile strength.

Figure 2:
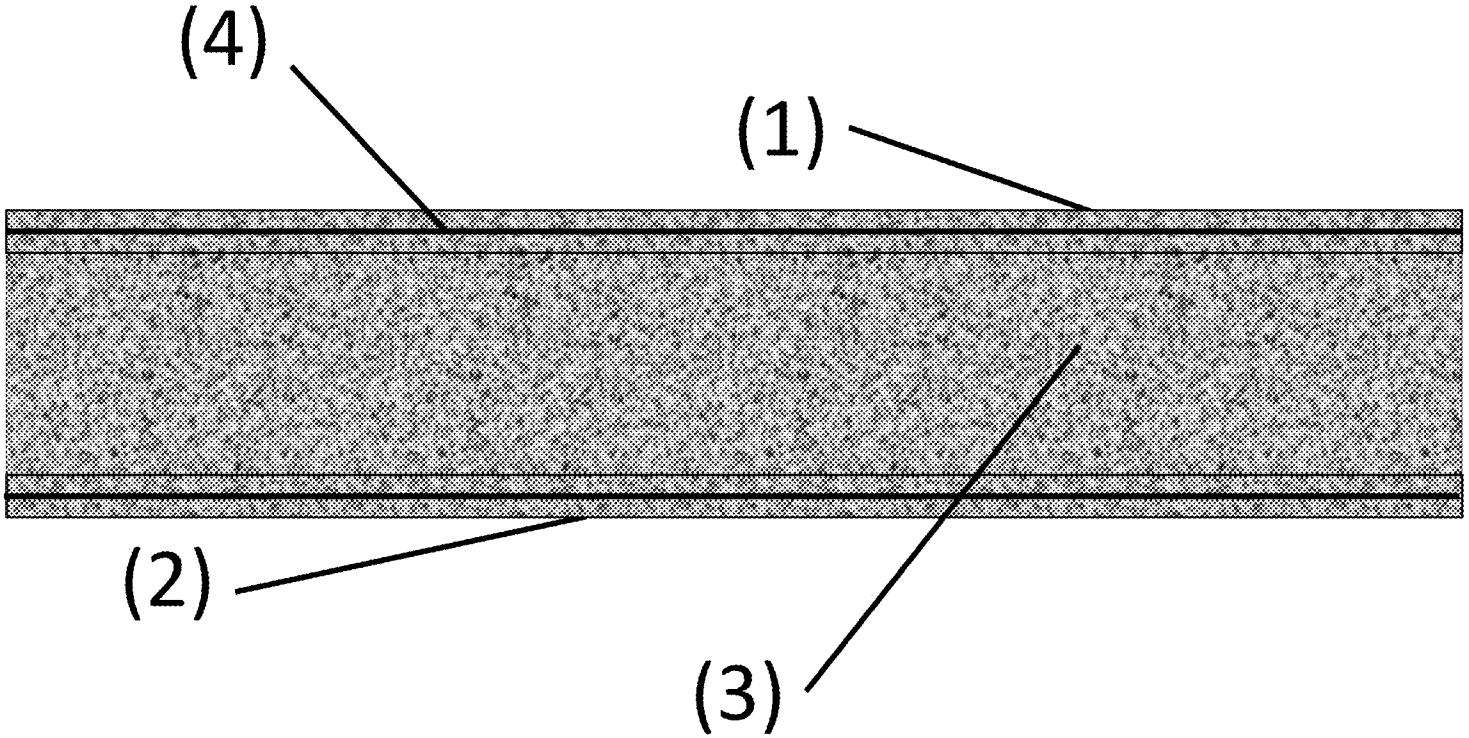
FIG. 2 is a diagram of the components of the double T-beam of FIG. 1 in an assembled configuration.

One of the many possible versions of the invention describes in FIG. 1 and FIG. 2 a CFS plate (1) as the upper chord and a second underlying stabilizing CFS plate (2) as the lower chord, each with an internal carbon layer (4) in the plates, with a web (3) arranged vertically to the plates (1) and (2) which is made of CFS, having also an internal carbon layer, which stiffens the overall arrangement. FIG. 1 shows the dovetailing and cutouts (5) of all panels which allow the panels to have interlocking structures which ensure cross-panel adhesion when the panels are interlocked with adhesives. The optimization of the components is achieved by the upper chord getting more stone contingent than the lower chord and the lower chord more carbon contingent than the upper chord. In the same way the carbon footprint can be optimized.

Figure 3:
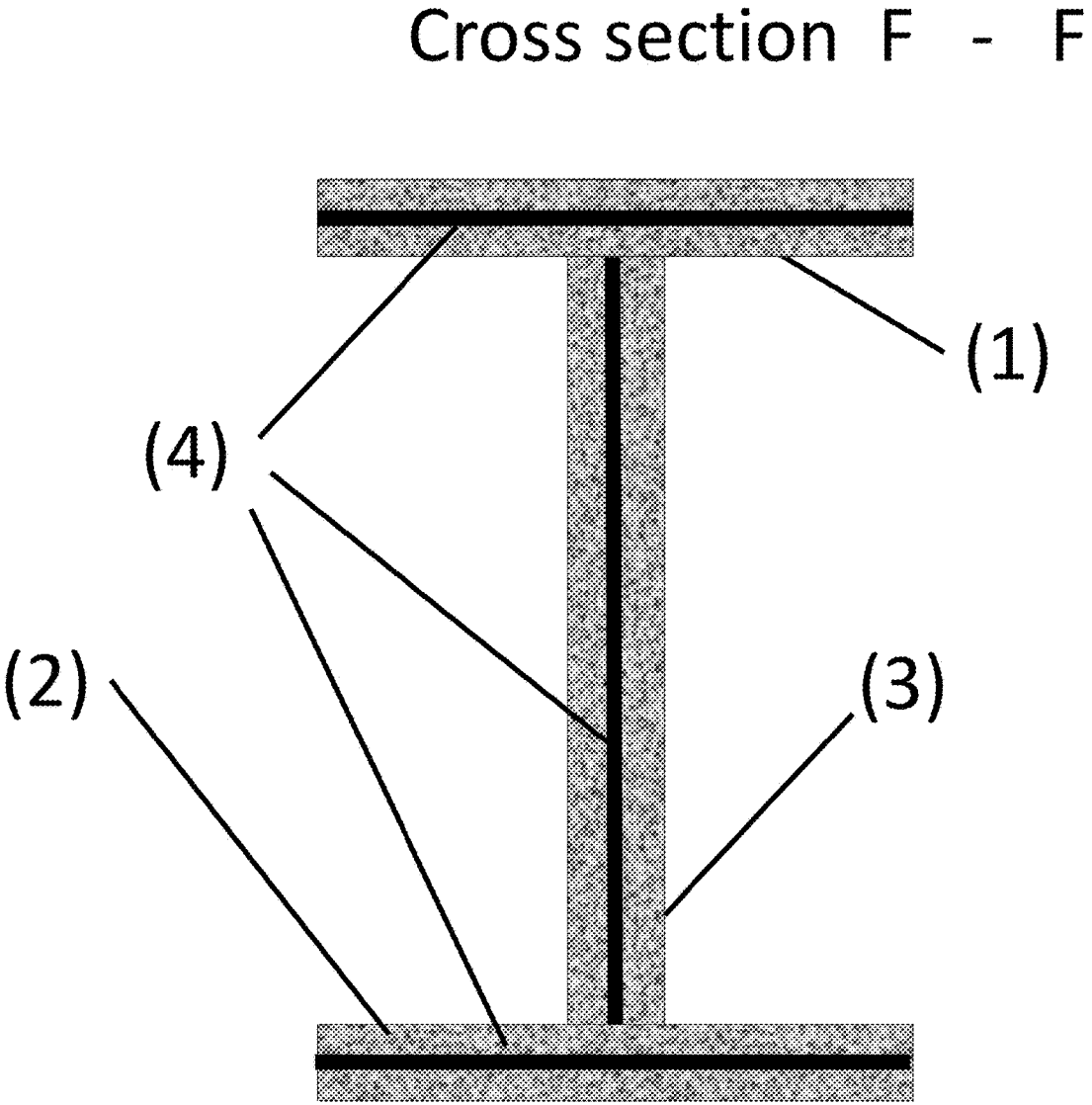
FIG. 3 is a cross- section view (F-F) of the double T-beam of FIG. 2.
Figure 4:
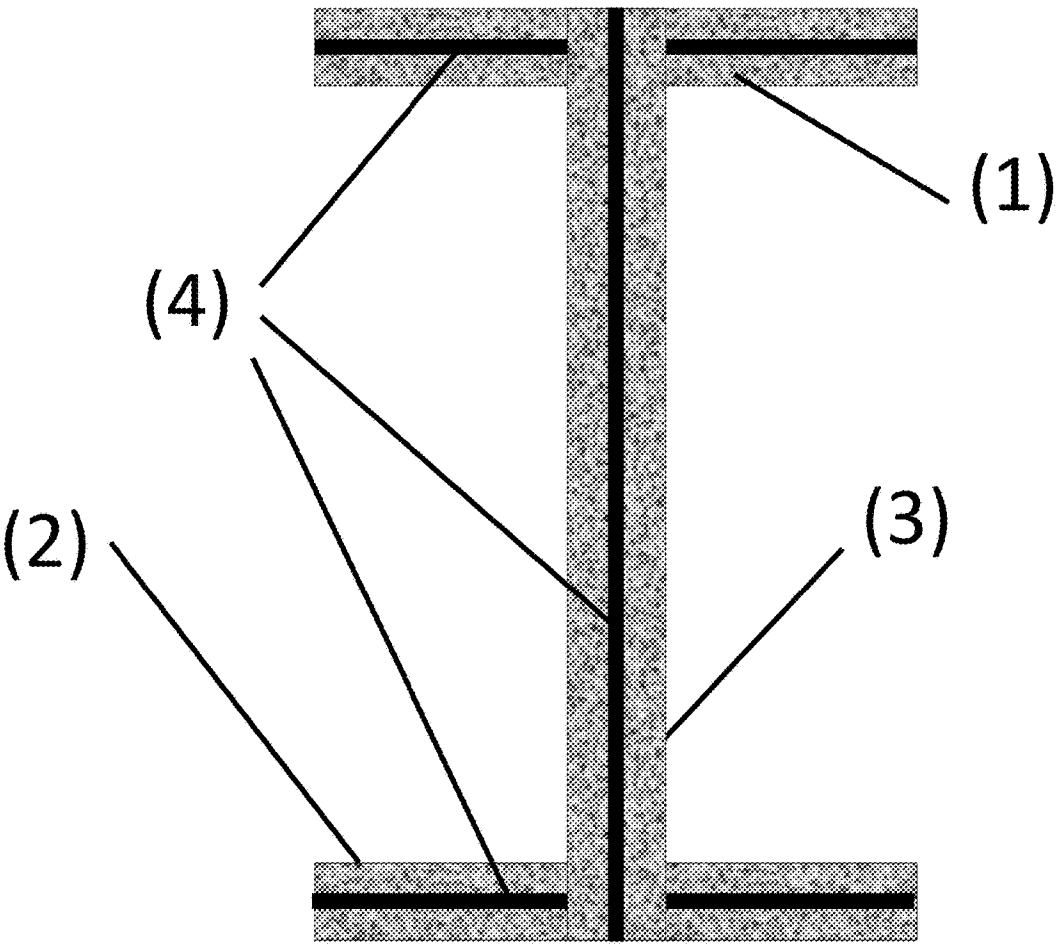
FIG. 4 is a cross-sectional view (G-G) of the double T-beam of FIG. 2.
Figure 5:
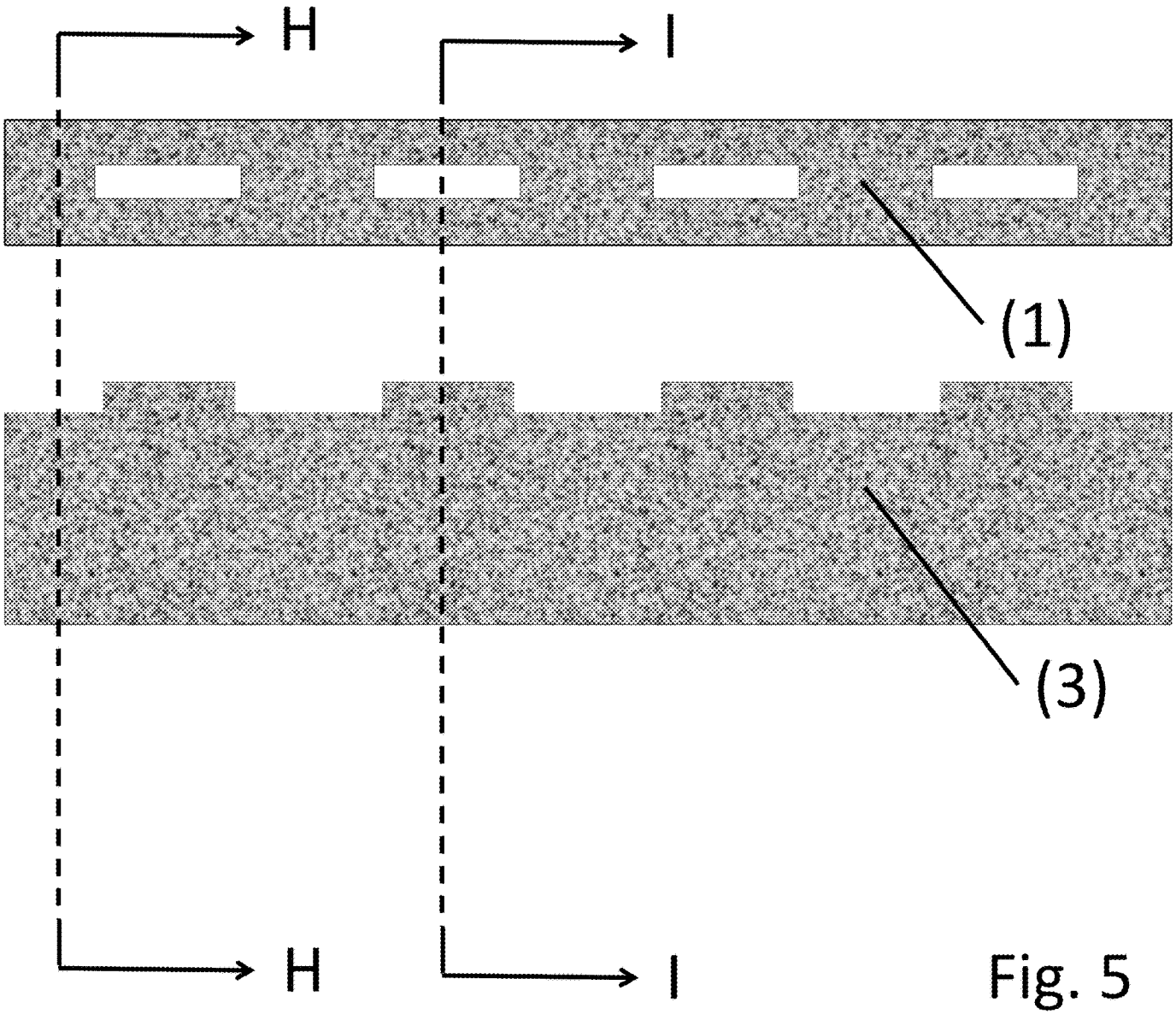
FIG. 5 is a diagram of components of a single T-beam.
Figure 6:
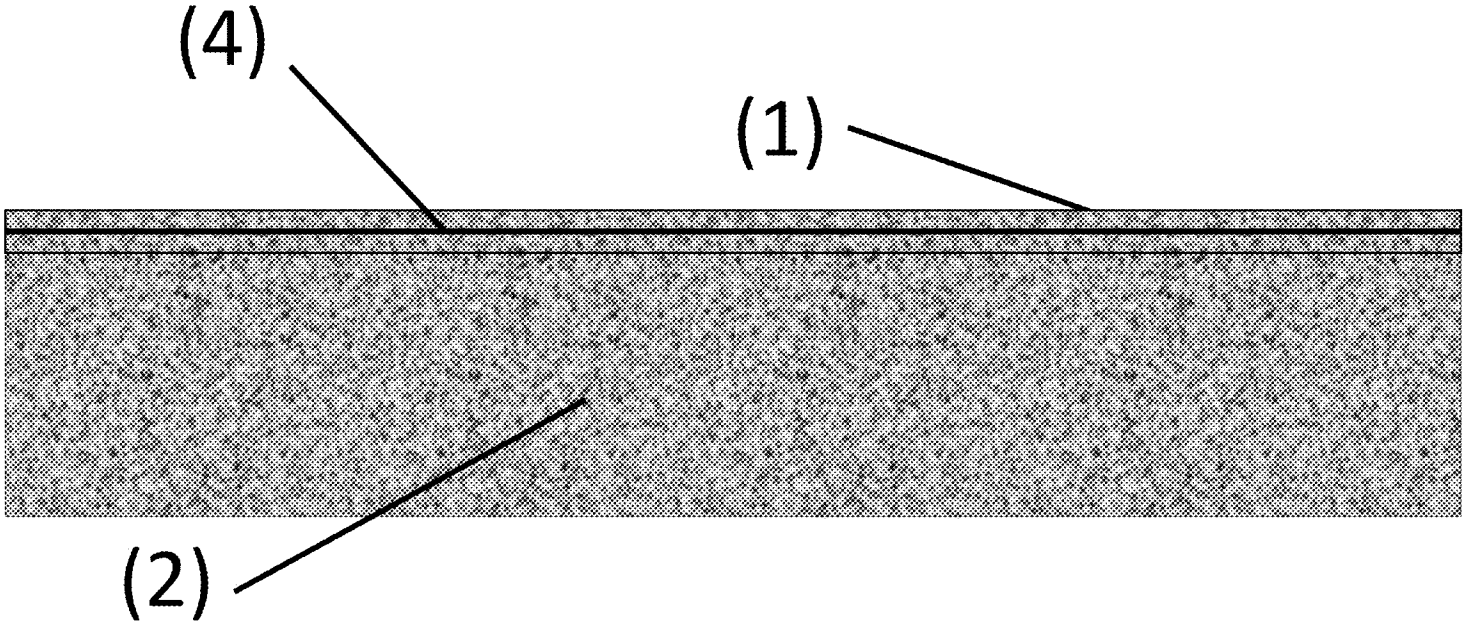
FIG. 6 is a diagram of the components of the single T-beam of FIG. 5 in an assembled configuration.
Figure 7:
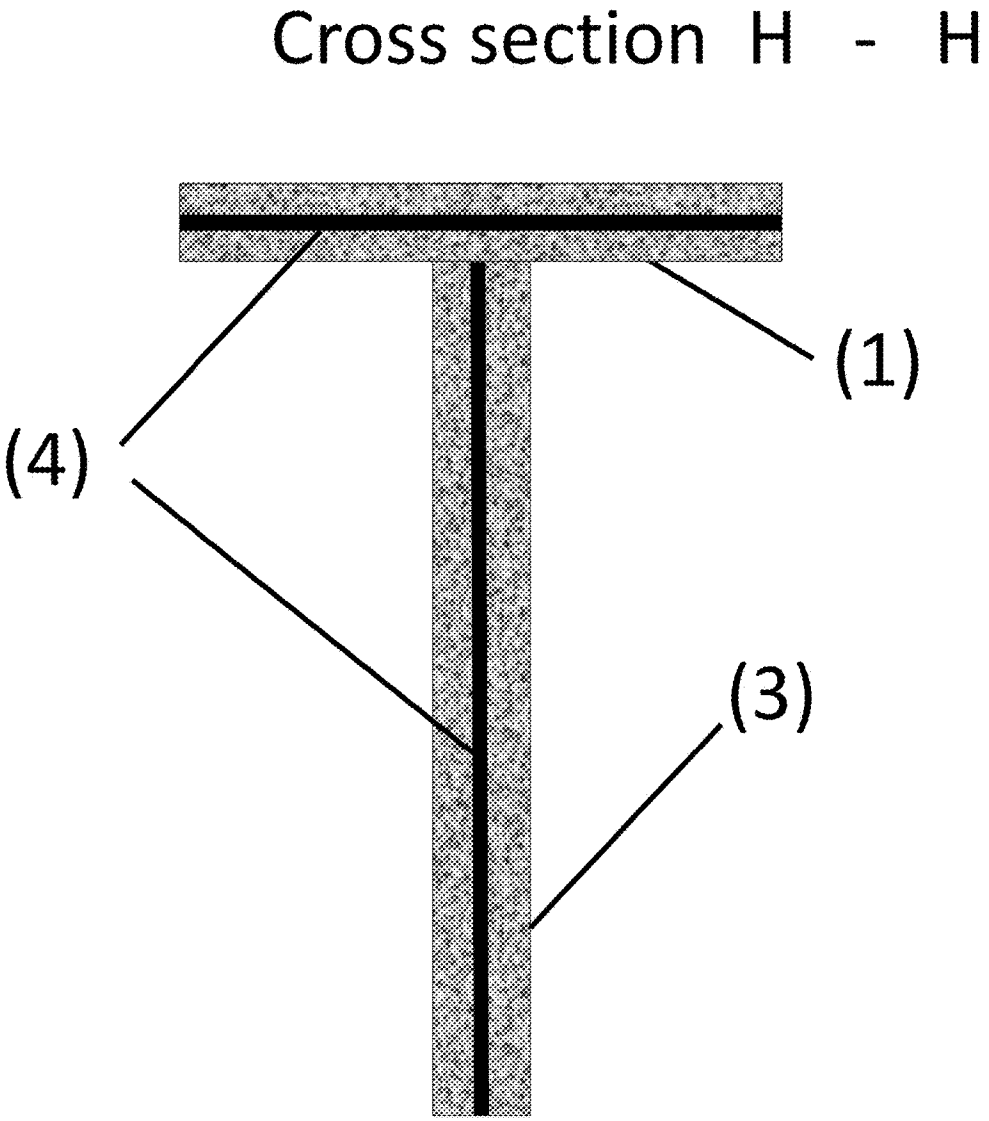
FIG. 7 is a cross-sectional view (H-H) of the single T-beam of FIG. 5.
Figure 8:
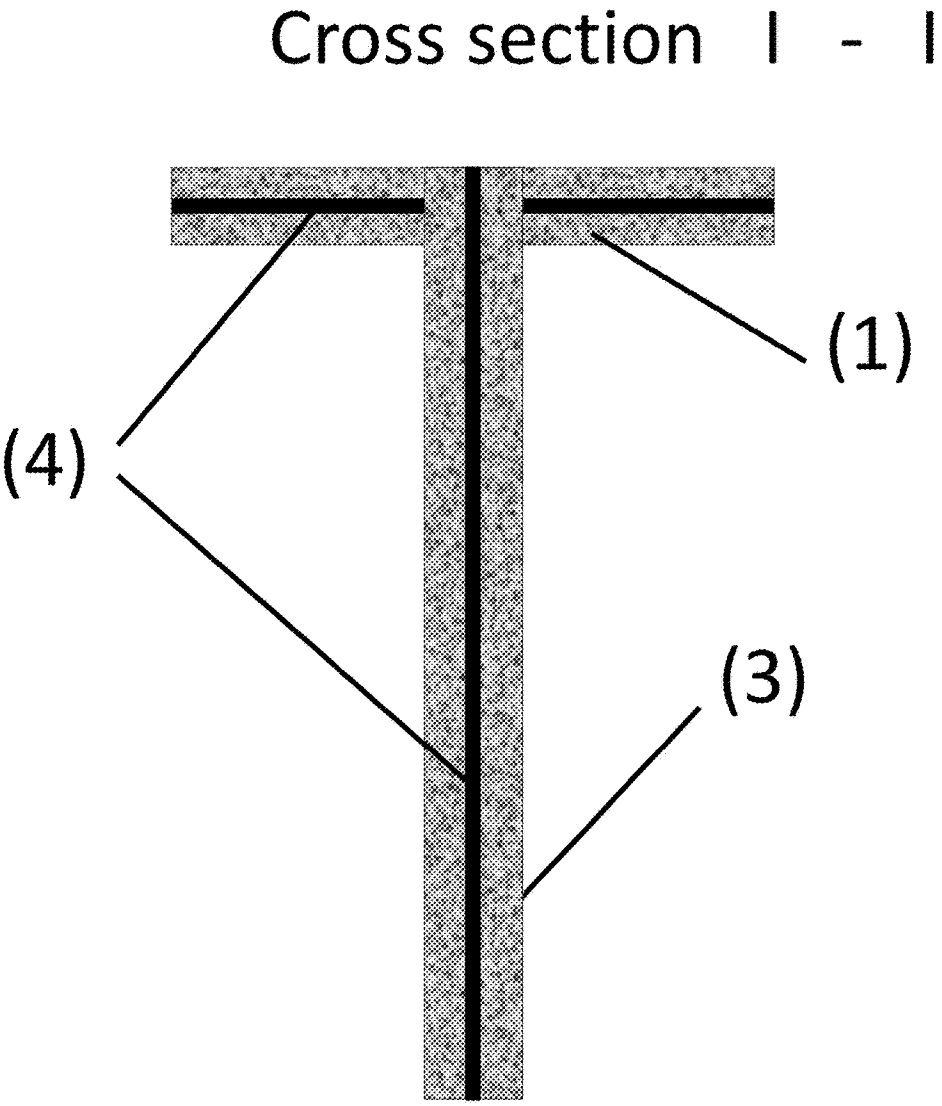
FIG. 8 is a cross-sectional view (I-I) of the single T-beam of FIG. 5.

FIGS. 3 and 4 show the structure of FIG. 2 in cross section (F-F) and (G-G), with which the two plates (1) and (2) are mechanically force fitting connected with the help of dovetails via the CFS plate (3).

The same is shown for a T-beam in FIGS. 5 to 8 as an example. The two designs are representative of the principle of connecting the CFS panels with the help of dovetailing of the edges to be glued together in order to also connect all possible other structures at right angles or at an angle and force-fitting by the fact that the carbon surfaces with high tensile strength viewed from the perspective of the cross section are in intersect or at least meet at a cutting line.

The invention claimed is:

1. A beam, comprising:

a first stone plate having (i) an upper surface, (ii) an opposing lower surface, and (iii) edge surfaces extending between the upper and lower surfaces; the first stone plate having a plurality of cutouts extending between the upper and lower surfaces;

a first fiber layer disposed within the first stone plate;

a second stone plate having (i) a first side surface angled relative to the upper surface of the first stone plate, (ii) an opposing second side surface, and (iii) edge surfaces extending between the first and second side surfaces, wherein one of the edge surfaces includes a plurality of protrusions extending into the cutouts to join the first stone plate with the second stone plate;

a second fiber layer disposed within the second stone plate.

2. The beam of claim 1, wherein the first stone plate includes one or more materials selected from the group consisting of:

natural stone;

concrete;

resin;

mineral-bound stone powder;

ceramic; and glass.

3. The beam of claim 1, wherein the first fiber layer includes one or more materials selected from the group consisting of:

carbon fiber;

plant fibers; and steel fibers.

4. The beam of claim 1, wherein the cutouts are arranged parallel to a length of the upper and lower surfaces.

5. The beam of claim 1, wherein the first fiber layer is parallel with the upper and lower surfaces, and embedded in between the upper and lower surfaces.

6. The beam of claim 1, wherein the first side surface of the second stone plate is perpendicular to the upper surface of the first stone plate.

7. The beam of claim 1, further comprising an additional fiber layer within the first stone plate.

8. The beam of claim 1, wherein the first fiber layer includes a plant-based substrate supporting fibers.

9. The beam of claim 1, further comprising a binder between a material of the first stone slab and the first fiber layer.

10. The beam of claim 9, wherein the binder includes water glass.

11. The beam of claim 1, further comprising:

a third stone plate having (i) a third upper surface, (ii) an opposing third lower surface, and (iii) third edge surfaces extending between the third upper and lower surfaces; the third stone plate having a plurality of cutouts extending between the third upper and lower surfaces;

wherein a further edge of the second stone plate includes protrusions extending through the cutouts of the third stone plate to join the third stone plate with the second stone plate; and a third fiber layer disposed within the third stone plate.

12. The beam of claim 11, wherein the second fiber layer extends into the protrusions, such that a plane of the second fiber layer intersects a plane of the first fiber layer.

* * * * *